US008294354B2

(12) United States Patent
Yang et al.

(10) Patent No.: US 8,294,354 B2
(45) Date of Patent: Oct. 23, 2012

(54) FIELD EMISSION LIGHT SOURCE DEVICE WITH IMPROVED LIGHT UTILIZATION EFFICIENCY

(75) Inventors: Tzung-Han Yang, Taipei (TW); Chi-Tsung Lo, Taipei (TW)

(73) Assignee: Tatung Company, Taipei (TW)

( * ) Notice: Subject to any disclaimer, the term of this patent is extended or adjusted under 35 U.S.C. 154(b) by 0 days.

(21) Appl. No.: 13/064,743

(22) Filed: Apr. 13, 2011

(65) Prior Publication Data

US 2012/0153808 A1 Jun. 21, 2012

(30) Foreign Application Priority Data

Dec. 16, 2010 (TW) ..... 99144217 A

(51) Int. Cl.
*H01J 63/04* (2006.01)

(52) U.S. Cl. ..... 313/495; 313/309; 313/494; 313/496; 313/310; 313/311

(58) Field of Classification Search ..... 313/495–497
See application file for complete search history.

(56) References Cited

U.S. PATENT DOCUMENTS

| | | | | |
|---|---|---|---|---|
| 5,637,958 | A * | 6/1997 | Levine | 313/496 |
| 5,911,616 | A * | 6/1999 | Levine et al. | 445/52 |
| 6,417,606 | B1 * | 7/2002 | Nakamoto et al. | 313/336 |
| 6,445,122 | B1 * | 9/2002 | Chuang et al. | 313/495 |
| 6,541,906 | B2 * | 4/2003 | Lee et al. | 313/495 |
| 7,598,665 | B2 * | 10/2009 | Li et al. | 313/495 |
| 7,830,078 | B2 * | 11/2010 | Lin et al. | 313/495 |
| 7,839,070 | B2 * | 11/2010 | Li et al. | 313/495 |
| 2005/0156506 | A1 * | 7/2005 | Chung et al. | 313/495 |

FOREIGN PATENT DOCUMENTS

| | | |
|---|---|---|
| CN | 1959503 | 5/2007 |
| TW | I256155 | 6/2006 |
| TW | I281684 | 5/2007 |
| TW | I304507 | 7/2007 |

* cited by examiner

*Primary Examiner* — Sikha Roy
(74) *Attorney, Agent, or Firm* — Bacon & Thomas, PLLC

(57) ABSTRACT

The present invention relates to a field emission light source device, which includes: a base substrate; at least one cathode strip, disposed over the base substrate; at least one emissive protrusion, disposed over the cathode strip and electrically connected to the cathode strip; an insulating layer, disposed over the cathode strip and having at least one opening to allow the emissive protrusion to protrude out of the opening; at least one anode strip, disposed over the insulating layer, where the cathode strip and the anode strip are arranged into an m×n matrix and the at least one anode strip individually has an impacted surface corresponding to the emissive protrude; and a phosphor layer disposed over the impacted surface. Accordingly, the present invention can enhance light utilization efficiency of a field emission light source device.

10 Claims, 5 Drawing Sheets

FIELD EMISSION LIGHT SOURCE DEVICE WITH IMPROVED LIGHT UTILIZATION EFFICIENCY

CROSS REFERENCE TO RELATED APPLICATION

This application claims the benefits of the Taiwan Patent Application Serial Number 099144217, filed on Dec. 16, 2010, the subject matter of which is incorporated herein by reference.

BACKGROUND OF THE INVENTION

1. Field of the Invention

The present invention relates to a field emission light source device, more particularly, to a field emission light source device with improved light utilization efficiency.

2. Description of Related Art

A field emission lamp is developed to replace a fluorescent lamp owing to the advantages of the former, such as its simple structure, high brightness, power saving feature, and its ability to satisfy the requirements of flatness and large scale. Moreover, in addition to light source systems for decoration, lighting or indication, a field emission lamp can further be applied to the backlight modules of LCDs.

FIG. 1 is a schematic view for illustrating the work principle of a field emission light source device. A field emission light source device mainly includes a cathode electrode 12, an electron emissive layer 14, an anode electrode 15, a phosphor layer 16 and a gate electrode 19. Herein, the anode electrode 15 and the phosphor layer 16 are formed on the front substrate 17, while the cathode electrode 12, the electron emissive layer 14 and the gate electrode 19 are disposed on the base substrate 11. Accordingly, when a voltage is applied between the cathode electrode 12 and the gate electrode 19, an electric field is formed between the cathode electrode 12 and the gate electrode 19 and thus the tunnel effect occurs whereby electrons are released from the electron emissive layer 14. Then, a voltage applied on the anode electrode 15 would accelerate the impact of the released electrons to the phosphor layer 16, resulting in the emission of light from the phosphor layer 16. Moreover, the gate electrode 19 can be used to accurately control the emission of electrons and to increase the electron current density, and the gate electrode 19 and the cathode electrode 12 can be electrically separated from each other by the insulating layer 13.

In general, electrons released from the electron emissive layer 14 merely impact to the surface 161 of the phosphor layer 16, and thus the highest luminous efficiency would be found from the surface 161 of the phosphor layer 16. That is, most of light emitted from the phosphor layer 16 is limited within the device and thus cannot be transmitted outwards. In addition, since the output window of the conventional field emission light source device is located against the surface 161 of the phosphor layer 16, the light transmitted outward from the surface 161 of the phosphor layer 16 has to pass through the phosphor layer 16, the anode electrode 15, and the front substrate 17, which results in the reduction of light extraction efficiency. Thereby, the aforementioned conventional field emission light source device generally has the disadvantage of low luminous efficiency.

SUMMARY OF THE INVENTION

The object of the present invention is to provide a field emission light source device in which the light utilization efficiency is enhanced and regional emission can be achieved by driving a single block or partial blocks. In addition, the field emission light source device according to the present invention can be applied on various purposes. For example, the field emission light source device according to the present invention may be a field emission lighting device.

To achieve the object, the present invention provides a field emission light source device, including: a base substrate; at least one cathode strip, disposed over the base substrate; at least one emissive protrusion, disposed over and electrically connected to at least one cathode strip; an insulating layer, disposed over the at least one cathode strip and having at least one opening to allow the at least one emissive protrusion to protrude out of the at least one opening; at least one anode strip, disposed over the insulating layer and having at least one impacted surface corresponding to the at least one emissive protrusion, in which the at least one cathode strip and the at least one anode strip are arranged into a m×n matrix, therewith each of m and n being an integer of 1 or more, and the at least one impacted surface is an inclined surface or a curved surface; and a phosphor layer, disposed over at least one impacted surface. Preferably, each of m and n is an integer greater than 1.

The field emission light source device according to the present invention may further include: a front substrate, disposed above the base substrate. Also, the field emission light source device according to the present invention may further include: a supporting unit, disposed between the base substrate and the front substrate, and the region between the base substrate and the front substrate can be a vacuum region. Herein, the base substrate may be an insulating substrate, and the front substrate may be a transparent substrate.

In the present invention, the cathode strip(s) and the anode strip(s) are formed into a strip structure, and the cross section of each anode strip may be, for example, triangle, trapezoid, semicircle or arch. Preferably, the bottom area of each anode strip is greater than the top area. More preferably, the longitudinal section area of each anode strip progressively increases from the top to the bottom thereof. In particular, each anode strip with trapezoid cross section may be used as a supporting element between the base substrate and the front substrate. Additionally, each anode strip may be higher than the emissive protrusion, and the phosphor layer may be disposed merely over the impacted surface at the lateral surface of the anode strip. That is, each anode strip may be provided with no phosphor layer over its top surface, whereas the top surface does not correspond to the emissive protrusion. In the present invention, the anode strip bottom area refers to the area of the anode strip at bottom facing to the base substrate, and the anode strip top area refers to the area of the anode strip at top facing to the front substrate. In addition, the cross section of an anode strip refers to a sectional surface vertical to the axial direction of the anode strip, and the longitudinal section of an anode strip refers to a sectional surface parallel to the axial direction of the anode strip.

According to the present invention, cathode strip(s), emissive protrusion(s), anode strip(s) and the phosphor layer are all placed over the base substrate, while the front substrate as an output window is placed above the surface of the phosphor layer where the highest luminous efficiency can be found. In comparison with the conventional field emission light source device where the output window is located at the bottom of the phosphor layer (i.e. located against the surface of the phosphor layer) and low luminous efficiency is shown, the field emission light source device according to the present invention can perform better luminous efficiency. Moreover, in the present invention, the anode strip(s) and the cathode strip(s) are arranged into a m×n matrix, and thus regional emission can be achieved by driving a single block or partial blocks.

Additionally, in the present invention, conductive materials capable of reflecting light are preferably applied to the impacted surface(s) of each anode strip, such that the light transmitted inward to the phosphor layer can be reflected from the impacted surface(s) of each anode strip to the front substrate so as to enhance light extraction efficiency. For example, in the present invention, each anode strip may be a strip-shaped body, which is preferably made of a conductive material capable of reflecting light. Alternatively, each anode strip may include a strip-shaped body and a conductive layer disposed over the strip-shaped body, therewith the conductive layer preferably being made of a conductive material capable of reflecting light, and the strip-shaped body preferably being empty or being made of a conductive material or a non-conductive material. Accordingly, each anode strip according to the present invention not only functions as an electrode, but also has the effect of reflecting light to enhance the light utilization efficiency of the field emission light source device according to the present invention.

In the present invention, each emissive protrusion may include a conductive protrusion and an electron emissive layer, therewith the conductive protrusion being electrically connected to the cathode strip, and the electron emissive layer being located over the conductive protrusion. Herein, the material of the conductive protrusion is not particularly limited, and may be any conventional suitable conductive material. Also, the conductive protrusion is not particularly limited in shape, and may be a rectangular bump or a cylinder bump. In addition, the material of the electron emissive layer according to the present invention is not particularly limited, and may be any conventional suitable electron emissive material, such as nano carbon materials, inclusive of carbon nanotubes and carbon nanowalls.

In the present invention, the phosphor layer is not particularly limited in material, and any conventional suitable fluorescent powder or phosphorous powder may be used alone or mixed according to various purposes or requirements. Accordingly, the phosphor layer may emit UV, IR, a monochromatic visible light, or a mixture of different visible light wavelengths (such as white light or light of other colors) and may be defined into one or more emissive regions. Each of the emissive regions may produce visible light of the same color. In the alternative, some of the phosphor areas may emit visible light of a different color to others of the phosphor areas. Moreover, the emissive regions may be arranged into different arrays according to various purposes or requirements.

As mentioned above, in the present invention, all main components (i.e. cathode strip(s), emissive protrusion(s), anode strip(s) and the phosphor layer) are placed over the base substrate, while the front substrate being as an output window is placed over the surface of the phosphor layer where the highest luminous efficiency can be found. In comparison with the conventional field emission light source device where the output window is located at the bottom of the phosphor layer (i.e. located against the surface of the phosphor layer) and low luminous efficiency is generated, the field emission light source device according to the present invention can show greater luminous efficiency. In particular, according to the present invention, conductive materials capable of reflecting light may be applied to the impacted surface(s) of each anode strip, such that the light transmitted inward to the phosphor layer can be reflected from the impacted surface(s) of each anode strip to the front substrate to enhance light extraction efficiency. Moreover, the anode strip(s) and the cathode strip(s) are arranged into a m×n matrix, and thus regional emission can be achieved by driving a single block or partial blocks.

BRIEF DESCRIPTION OF THE. DRAWINGS

DETAILED DESCRIPTION OF THE PREFERRED EMBODIMENT

Hereafter, examples will be provided to illustrate the embodiments of the present invention. Other advantages and effects of the invention will become more apparent from the disclosure of the present invention. It should be noted that these accompanying figures are simplified. The quantity, shape and size of components shown in the figures may be modified according to practically conditions, and the arrangement of components may be more complex. Other various aspects in the invention also may be practiced or applied by definite embodiments, and various modifications and variations can be made without departing from the spirit of the invention based on various concepts and applications.

Example 1

Figure 1:
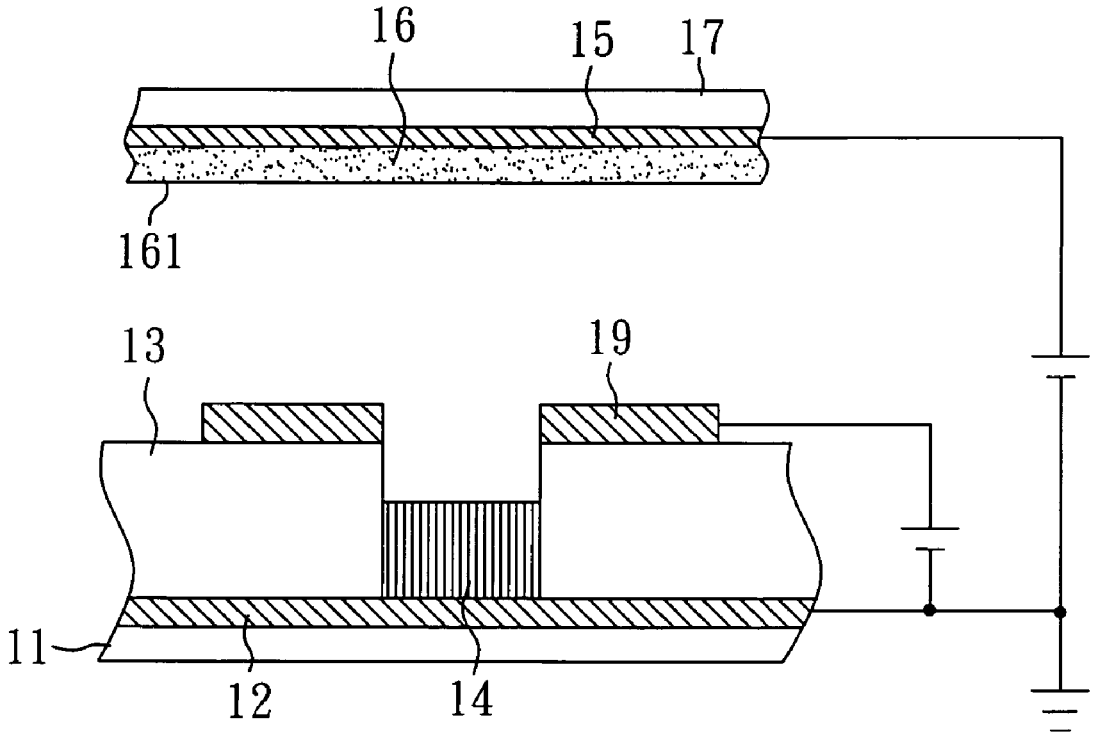
FIG. 1 (PRIOR ART)
FIG. 1 shows a schematic view for illustrating the work principle of a field emission light source device.
Figure 2A:
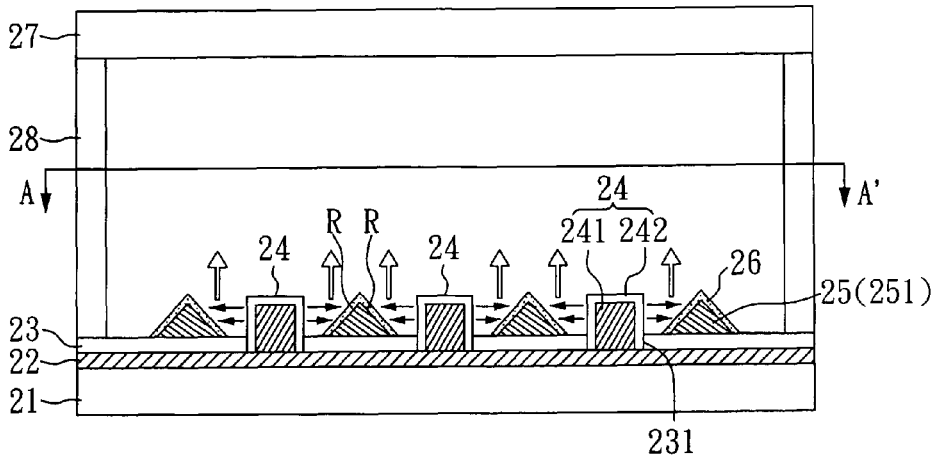
FIG. 2A shows a cross-sectional view of a field emission light source device according to Example 1 of the present invention.

FIG. 2A shows a cross-sectional view of a field emission light source device according to one preferred example of the present invention, which mainly includes: a base substrate 21, cathode strips 22, an insulating layer 23, emissive protrusions 24, anode strips 25, a phosphor layer 26, a front substrate 27 and a supporting unit 28. Herein, the supporting unit 28 is disposed between the base substrate 21 and the front substrate 27, and the region between the base substrate 21 and the front substrate 27 is a vacuum region. In addition, the cathode strips 22, the emissive protrusions 24, the anode strips 25 and the phosphor layer 26 are disposed on the base substrate 21, while the front substrate 27 as an output window is disposed above the surface of the phosphor layer where the highest luminous efficiency can be found. Accordingly, in comparison with the conventional field emission light source device where the output window is located at the bottom of the phosphor layer (i.e. located against the surface of the phosphor layer) and low luminous efficiency is shown, the field emission light source device according to the present example can show improved luminous efficiency. Particularly, in the field emission light source device according to the present example, the light transmitted inward to the phosphor layer 26 can be further reflected to the front substrate 27 via the impacted surfaces R of the anode strips 25, resulting in the enhancement of light extraction efficiency.

In detail, as shown in FIG. 2A, each of the cathode strips 22 is formed on the base substrate 21, and an insulating layer 23 is formed on the cathode strips 22 so as to electrically separate the cathode strips 22 from the anode strips 25. In addition, the insulating layer 23 has a plurality of openings 231 to expose partial regions of the cathode strips 22, and the emissive protrusions 24 are disposed in the openings 231, electrically connected to the cathode strips 22 and protrude out of the openings 231. In the present example, each of the emissive protrusions 24 includes a conductive protrusion 241 and an electron emissive layer 242, in which the conductive protrusion 241 is electrically connected to its corresponding cathode strip 22, and the electron emissive layer 242 is disposed over the surface of the conductive protrusion 241. Accordingly, electrons can be emitted from the electron emissive layer 242 and impact to the phosphor layer 26 over the anode strips 25, resulting in emission of light.

Figure 2B:
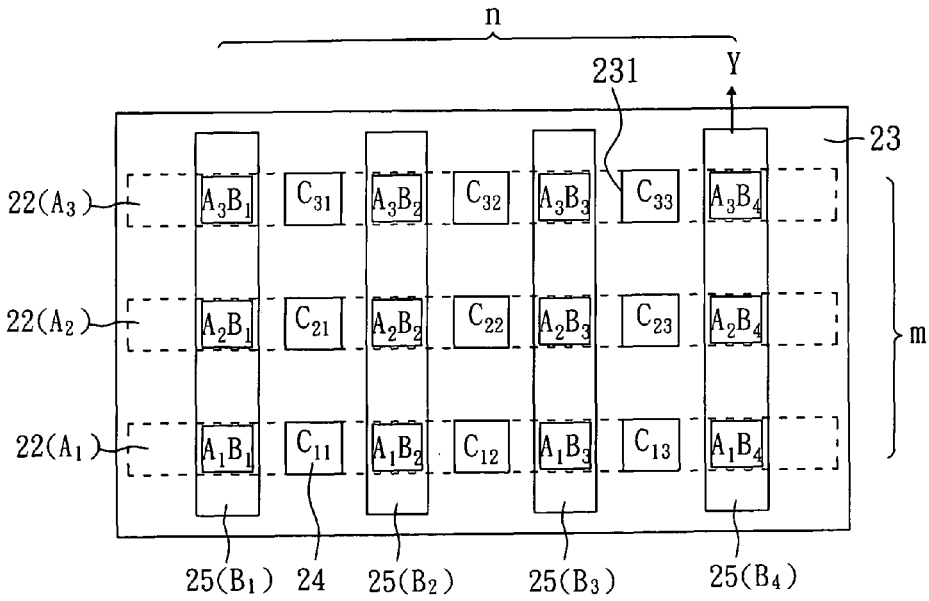
FIG. 2B shows a top view along the line AA' in FIG. 2A.

Moreover, as shown in FIG. 2A, each of the anode strips 25 according to the present example is a strip-shaped body 251 with a triangle cross section (vertical to the axial direction Y of the anode strip 25 shown in FIG. 2B), and the impacted surface R corresponding to the emissive protrusion 24 is an inclined surface. Herein, the phosphor layer 26 is disposed over the impacted surfaces R of the anode strips 25, and the longitudinal section area (parallel to the axial direction Y of the anode strip 25 shown in FIG. 2B) of each anode strip 25 increases from the top to the bottom. Accordingly, the light emitted from the phosphor layer 26 can be transmitted toward the front substrate 27 and projected out of the device. Furthermore, the strip-shaped body 251 as an anode strip 25 according to the present example is made of a conductive material capable of reflecting light, such as aluminum that is applied in the present example. Accordingly, when electrons emitted from the electron emissive layer 242 impact to the phosphor layer 26 over the impacted surfaces R of the anode strips 25, the impacted surfaces R of the anode strips 25 would reflect the light emitted from the phosphor layer 26 to the front substrate 27 above the base substrate 21, resulting in the enhancement of light utilization efficiency. In comparison with the conventional field emission light source device in which an ITO electrode is used as an anode, the present example utilizes a material capable of effectively evacuating charges as the material of the anode strips 25, such that accumulation of charges can be inhibited. Furthermore, no more expensive ITO anode applied and required in the conventional field emission light source device has to be used in the field emission light source device according to the present example. In the present example, the front substrate 27 is a transparent substrate, such that light reflected from the impacted surfaces R can pass through the front substrate 27 and be transmitted outward.

For further illustration, please see FIG. 2B which shows a top view along the line AA' in FIG. 2A. As shown in FIG. 2B, in the present example, the plural cathode strips 22 (signed as $A_1$, $A_2$ and $A_3$) are arranged into an array on the base substrate. Herein, the base substrate is an insulating substrate. Then, the insulating layer 23 is disposed over the base substrate and the cathode strips 22 and has a plurality of openings 231 to allow the emissive protrusions 24 to be formed on the cathode strips 22 and protrude out of the openings 231. Finally, a plurality of triangle anode strips 25 (signed as $B_1$, $B_2$, $B_3$ and $B_4$) are arranged into an array on the insulating layer 23 to form an m×n matrix with the cathode strips 22 (the present example takes a 3×4 matrix for illustration), and the emissive protrusions 24 are located between adjacent anode strips 25. Accordingly, for example, when low potential and high potential are applied on the cathode strip $A_1$ and the anode strip $B_1$, respectively, electrons would be emitted from the emissive protrusion $C_{11}$ and then impact to the emissive region $A_1B_1$, such that the emissive region $A_1B_1$ would emit light. Similarly, when low potential and high potential are applied on the cathode strip $A_1$ and the anode strip $B_2$, respectively, electrons would be emitted from the emissive protrusions $C_{11}$ and $C_{12}$ and then impact to the emissive region $A_1B_2$, such that the emissive region $A_1B_2$ would emit light. Thereby, the cathode strips $A_1$, $A_2$, $A_3$ and the anode strips $B_1$, $B_2$, $B_3$, $B_4$ can be selectively applied with low potential and high potential to selectively drive the emissive regions in the m×n matrix, such as $A_1B_1$, $A_1B_2$, $A_1B_3$, $A_2B_2$, $A_3B_4$, so as to achieve regional emission. Additionally, plural emissive regions may simultaneously emit light by driving two or more cathode strips and/or anode strips. For example, when low potential and high potential are applied on the cathode strip $A_1$ and the anode strips $B_2$, $B_3$, respectively, electrons would be emitted from the emissive protrusions $C_{11}$, $C_{12}$ and $C_{13}$ and then impact to the emissive regions $A_1B_2$ and $A_1B_3$, such that the emissive regions $A_1B_2$ and $A_1B_3$ would simultaneously emit light. Similarly, when low potential and high potential are applied on the cathode strips $A_1$, $A_2$ and the anode strips $B_2$, $B_3$, respectively, electrons would be emitted from the emissive protrusions $C_{11}$, $C_{12}$, $C_{13}$, $C_{21}$, $C_{22}$ and $C_{23}$ and then impact to the emissive regions $A_1B_2$, $A_1B_3$, $A_2B_2$, $A_2B_3$, such that the emissive regions $A_1B_2$, $A_1B_3$, $A_2B_2$, $A_2B_3$ would simultaneously emit light. Also, all cathode strips and anode strips may be simultaneously driven so as to achieve overall lighting effect.

Example 2

Figure 3:
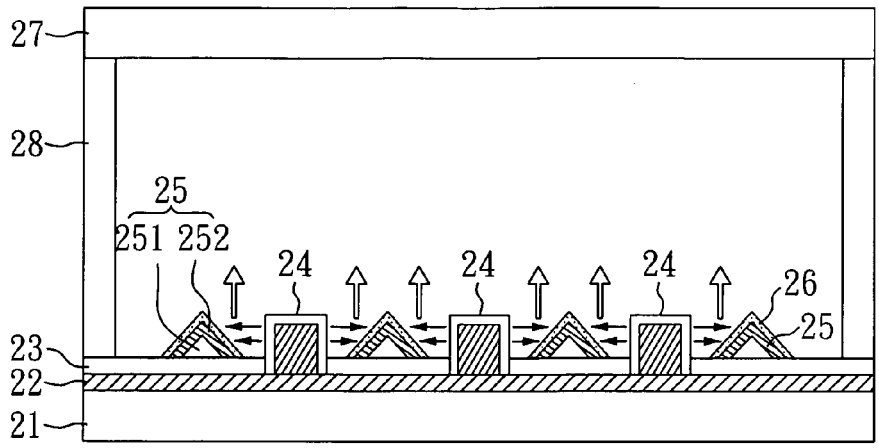
FIG. 3 shows a cross-sectional view of a field emission light source device according to Examples 2 and 3 of the present invention.

The field emission light source device according to the present example is the same as that illustrated in Example 1, except that each anode strip 25 according to the present example consists of a strip-shaped body 251 and a conductive layer 252, as shown in FIG. 3. Herein, the strip-shaped body 251 is made of a non-conductive material, and the conductive layer 252 is made of a conductive material capable of reflecting light (e.g. the present example applies aluminum in the conductive layer) so as to reflect light and to conduct current.

Example 3

The field emission light source device according to the present example is the same as that illustrated in Example 2, except that the strip-shaped body 251 of each anode strip 25 according to the present example is empty, as shown in FIG. 3.

Example 4

Figure 4:
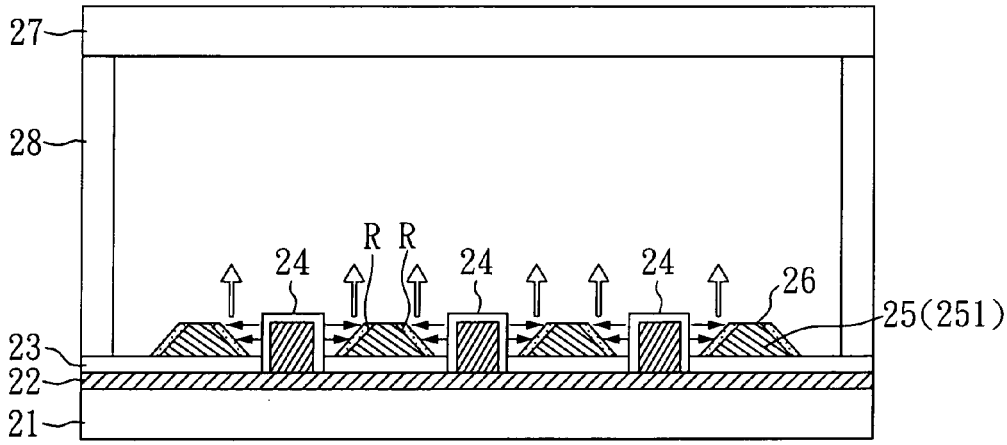
FIG. 4 shows a cross-sectional view of a field emission light source device according to Example 4 of the present invention.

The field emission light source device according to the present example is the same as that illustrated in Example 1, except that each anode strip 25 according to the present example consists of a strip-shaped body 251 with a trapezoid cross section, as shown in FIG. 4. Herein, two lateral inclined surfaces of the anode strip 25, which correspond to the emissive protrusions 24, are impacted surfaces R, and each impacted surface R is provided with a phosphor layer 26 thereon.

In addition, according to another aspect of the present example, the top of each anode strips 25 can contact directly with the front substrate 27 and is provided with no phosphor layer 26 thereon (that is, the phosphor layer 26 is disposed merely on two lateral surfaces of the anode strips 25). Accordingly, the anode strips 25 can function as supporting elements between the base substrate 21 and the front substrate 27.

Example 5

Figure 5:
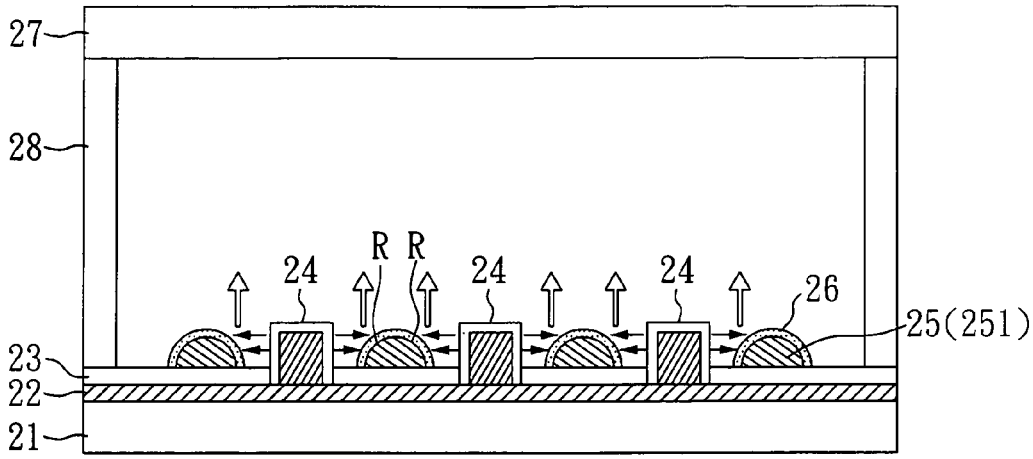
FIG. 5 shows a cross-sectional view of a field emission light source device according to Example 5 of the present invention.

The field emission light source device according to the present example is the same as that illustrated in Example 1, except that each anode strip 25 according to the present example consists of a strip-shaped body 251 with a semicircular cross section, as shown in FIG. 5. Herein, the two lateral curved surfaces of the anode strip 25, which correspond to the emissive protrusions 24, are impacted surfaces R, and each impacted surface R is provided with a phosphor layer 26 thereon.

Example 6

Figure 6:
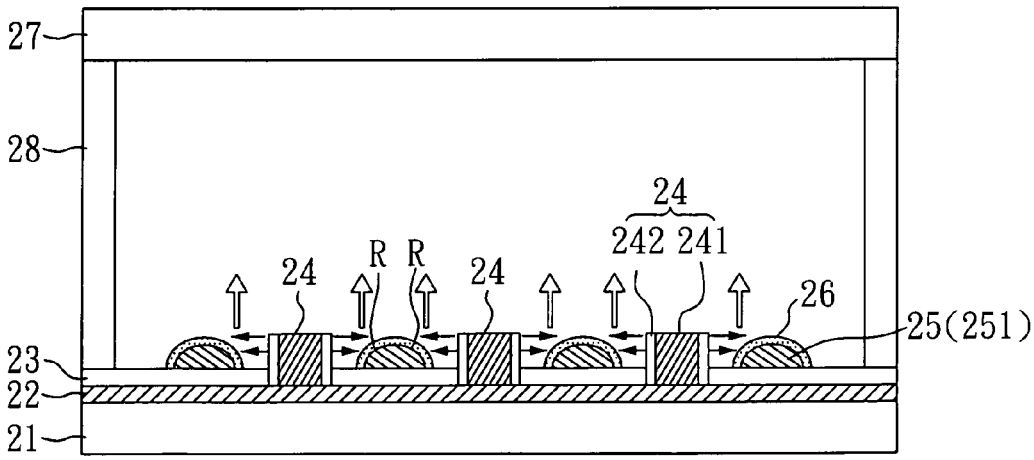
FIG. 6 shows a cross-sectional view of a field emission light source device according to Example 6 of the present invention.

The field emission light source device according to the present example is the same as that illustrated in Example 1, except that each anode strip 25 according to the present example consists of a strip-shaped body 251 with an arch-liked cross section, as shown in FIG. 6. Herein, the two lateral curved surfaces of the anode strip 25, which correspond to the emissive protrusions 24, are impacted surfaces R, and each impacted surface R is provided with a phosphor layer 26 thereon. In addition, the electron emissive layer 242 of each emissive protrusion 24 is disposed merely on the lateral surfaces of the conductive protrusion 241, which correspond to the anode strips 25. That is, the top of each conductive protrusion 241 is provided with no electron emissive layer 242.

Example 7

Figure 7:
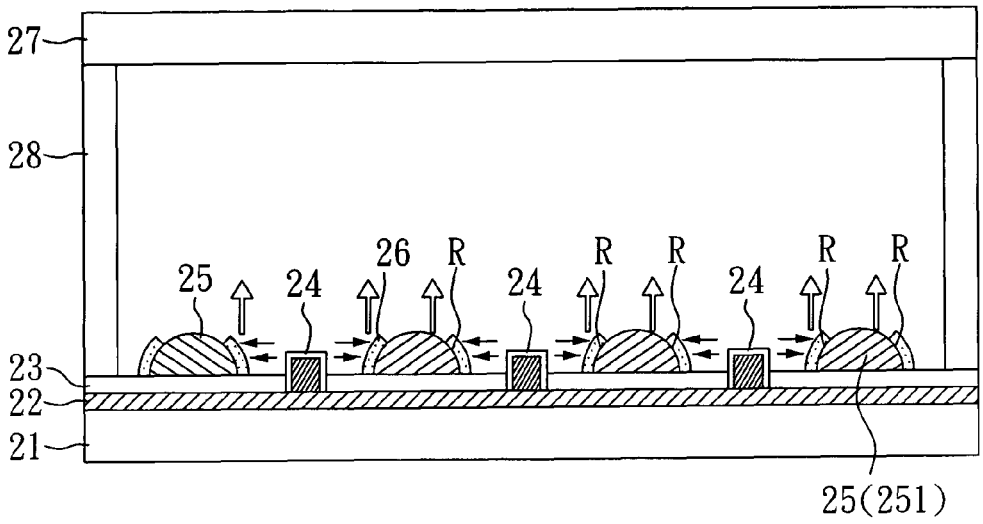
FIG. 7 shows a cross-sectional view of a field emission light source device according to Example 7 of the present invention.

The field emission light source device according to the present example is the same as that illustrated in Example 5, except that each anode strip 25 according to the present example is higher than the emissive protrusion 24, and each anode strip 25 is provided with the phosphor layer 26 merely on its impacted surfaces R (i.e. its lateral surfaces corresponding to the emissive protrusions 24), as shown in FIG. 7. That is, each anode strip 25 is provided with no phosphor layer 26 over its top surface, whereas the top surface does not correspond to the emissive protrusion 24.

Accordingly, in the present invention, all main components (i.e. cathode strip(s), emissive protrusion(s), anode strip(s) and the phosphor layer) are placed over the base substrate, while the front substrate as the output window is placed over the surface of the phosphor layer where the highest luminous efficiency can be found. In comparison with the conventional field emission device where the output window is located at the bottom of the phosphor layer (i.e. located against the surface of the phosphor layer) and low luminous efficiency is shown, the field emission device according to the present invention can show better luminous efficiency. In particular, according to the present invention, conductive materials capable of reflecting light may be applied in the impacted surfaces of anode strips, such that the light transmitted inward to the phosphor layer can be reflected from the impacted surfaces of anode strips to the front substrate so as to enhance light extraction efficiency. Moreover, the anode strip(s) and the cathode strip(s) are arranged into an m×n matrix, and thus regional emission can be achieved by driving a single block or partial blocks.

The above examples are intended for illustrating the embodiments of the subject invention and the technical features thereof, but not for restricting the scope of protection of the subject invention. The scope of the subject invention is based on the claims as appended.

What is claimed is:

1. A field emission light source device, comprising:

a base substrate;

at least one cathode strip, disposed over the base substrate;

at least one emissive protrusion, disposed over and electrically connected to the at least one cathode strip;

an insulating layer, disposed over the at least one cathode strip and having at least one opening to allow the at least one emissive protrusion to protrude out of the at least one opening;

at least one anode strip, disposed over the insulating layer and having at least one impacted surface corresponding to the at least one emissive protrusion, wherein the at least one cathode strip and the at least one anode strip are electrically separated from each other by the insulating layer and arranged into a m×n matrix, therewith each of m and n being an integer of 1 or more, and the at least one impacted surface is an inclined surface or a curved surface; and a phosphor layer, disposed over the at least one impacted surface, wherein the at least one cathode strip, the at least one emissive protrusion, the insulating layer, the at least one anode strip and the phosphor layer are placed at the base substrate.

2. The field emission light source device as claimed in claim 1, wherein the at least one anode strip has a greater bottom area than a top area.

3. The field emission light source device as claimed in claim 2, wherein the at least one anode strip has a triangle, trapezoid, semicircle or arch cross section.

4. The field emission light source device as claimed in claim 2, wherein the at least one impacted surface of the at least one anode strip is made of a conductive material capable of reflecting light.

5. The field emission light source device as claimed in claim 4, wherein the at least one anode strip is a strip-shaped body, and the strip-shaped body is made of the conductive material capable of reflecting light.

6. The field emission light source device as claimed in claim 4, wherein the at least one anode strip comprises a strip-shaped body and a conductive layer disposed over the strip-shaped body, therewith the conductive layer being made of the conductive material capable of reflecting light.

7. The field emission light source device as claimed in claim 2, further comprising: a front substrate, disposed above the base substrate.

8. The field emission light source device as claimed in claim 7, further comprising: a supporting unit, disposed between the base substrate and the front substrate, wherein a region between the base substrate and the front substrate is a vacuum region.

9. The field emission light source device as claimed in claim 2, wherein the at least one emissive protrusion comprises a conductive protrusion and an electron emissive layer, and the electron emissive layer is disposed over the conductive protrusion.

10. The field emission light source device as claimed in claim 2, wherein the at least one anode strip is higher than the at least one emissive protrusion.

* * * * *